US009230715B2

(12) United States Patent
Suzuki et al.

(10) Patent No.: US 9,230,715 B2
(45) Date of Patent: Jan. 5, 2016

(54) FLAT CABLE

(71) Applicant: Yazaki Corporation, Tokyo (JP)

(72) Inventors: Toshirou Suzuki, Susono (JP); Maki Yamada, Susono (JP)

(73) Assignee: Yazaki Corporation, Tokyo (JP)

( * ) Notice: Subject to any disclaimer, the term of this patent is extended or adjusted under 35 U.S.C. 154(b) by 38 days.

(21) Appl. No.: 14/055,088

(22) Filed: Oct. 16, 2013

(65) Prior Publication Data

US 2014/0116750 A1 May 1, 2014

(30) Foreign Application Priority Data

Oct. 31, 2012 (JP) ..... 2012-240349
Nov. 29, 2012 (JP) ..... 2012-261051

(51) Int. Cl.
*H01B 7/00* (2006.01)
*H01B 7/08* (2006.01)
*H01B 3/44* (2006.01)

(52) U.S. Cl.
CPC ..... *H01B 7/0823* (2013.01); *H01B 3/443* (2013.01)

(58) Field of Classification Search
USPC .... 174/110 R, 110 AR–110 V, 113 R, 117 R, 174/117 F, 117 FF, 120 R, 120 SR
See application file for complete search history.

(56) References Cited

U.S. PATENT DOCUMENTS 4,468,089 A * 8/1984 Brorein ..... 385/114
4,556,694 A * 12/1985 Wallace ..... 525/239
4,835,394 A * 5/1989 Steele ..... 250/385.1
4,992,311 A * 2/1991 Hisazumi et al. ..... 428/35.4
5,091,610 A * 2/1992 Strauss ..... 174/117 F
5,157,068 A * 10/1992 Chung ..... 524/318
5,360,944 A * 11/1994 Springer et al. ..... 174/117 F
6,271,301 B1 * 8/2001 Weng et al. ..... 524/527

FOREIGN PATENT DOCUMENTS

JP 10-241162 A 9/1998
JP 2001-250429 A * 2/2000 ..... H01B 13/00
JP WO 01/51543 A2 * 7/2001
JP 2001-250429 A 9/2001
JP 2003-064232 A * 3/2003 ..... C08L 27/06
WO WO-01/51543 A2 7/2001
WO WO01/51543 A2 * 7/2001
WO WO-2013/081183 A1 6/2013

OTHER PUBLICATIONS

European Search Report dated Feb. 26, 2014, issued for the European patent application No. 13189241.6.

* cited by examiner

*Primary Examiner* — William H Mayo, III

(74) *Attorney, Agent, or Firm* — Locke Lord LLP; James E. Armstrong, IV; Brian S. Matross

(57) ABSTRACT

A flat cable includes at least two conductors offset from and in parallel with one another, and an insulating covering disposed over a periphery of the conductors. The insulating covering includes a vinyl chloride-based resin composition with a brittle temperature from −40° Celsius to −25° Celsius, a hardness D from 35 to 55, and heating deformation of 10% or below. The vinyl chloride-based resin composition substantially contains only vinyl chloride homopolymer as the resin component.

6 Claims, 1 Drawing Sheet

(a)

(b)

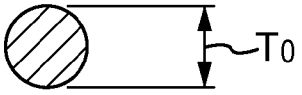
(a)
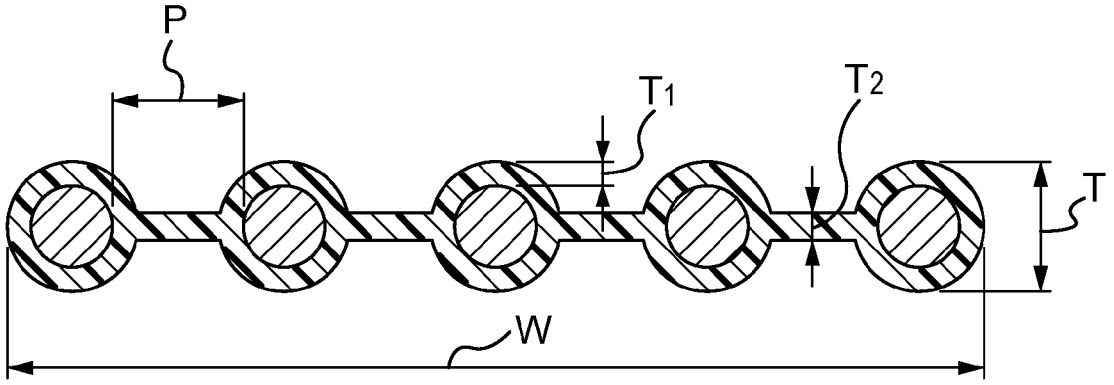
(b)

FLAT CABLE

CROSS-REFERENCE TO RELATED APPLICATIONS

This application claims priority from Japanese Patent Application No. 2012-261051 filed on Nov. 29, 2012 and Japanese Patent Application No. 2012-240349 filed on Oct. 31, 2012, which are incorporated herein by reference.

BACKGROUND OF THE INVENTION

1. Field of the Invention

The invention relates to a flat cable, in particular a space-saving flat cable, suitable for use in a vehicle.

2. Background of the Invention

Recently, space-saving has been strongly required for a wiring member with weight-saving and downsizing of a vehicle. For the reason, even in the case of a flat cable which is effective in the light of space-saving, further decrease in the thickness of a conductor portion and an insulating layer has been required. However, as the thickness of the insulating layer decreases, wear resistance of the insulating layer may be deteriorated. When vinyl chloride-based resin is used as an insulating layer material, the content of plasticizer is decreased to harden the insulating layer. In this case, wear resistance of the insulating layer thus obtained is enhanced. See JP H10-241162 A. Unfortunately, lower temperature resistance may be degraded or deteriorated with the increase in wear resistance.

SUMMARY OF THE INVENTION

In order to overcome the afore-mentioned problems, the invention provides a new flat cable having a thinner insulating layer while maintaining sufficient wear resistance and low temperature resistance.

In one aspect, the invention provides a flat cable, which includes at least two conductors disposed apart from each other and in parallel to each other, and an insulating covering disposed over a periphery of the at least two conductors, and formed of vinyl chloride-based resin composition having a brittle temperature of from −40 Celsius degrees to −25 Celsius degrees, an hardness D of from 35 to 55, and heating deformation of 10% or below.

Preferably, a thickness of the insulating covering disposed over the conductor is from 0.1 mm to 0.2 mm. Preferably, conductor is formed of a single wire or a stranded wire, and has a cross-sectional area of from 0.01 $mm^2$ to 0.13 $mm^2$.

Preferably, a thickness of the insulating covering disposed over the conductor is from 0.1 mm to 0.2 mm. Preferably, the conductor is a rectangular conductor, a width of which is greater than a thickness of the rectangular conductor. The thickness of the rectangular conductor may be from 0.02 mm to 0.5 mm. The rectangular conductor may be arranged such that a width direction of the rectangular conductor corresponds to a width direction of the flat cable.

In another aspect, the invention provides a vinyl-chloride-based resin composition suitable for an insulating covering of a flat cable, which has a brittle temperature of from −40 Celsius degrees to −25 Celsius degrees, an hardness D of from 35 to 55, and heating deformation of 10% or below.

The chloride-the resin composition in accordance with the invention makes the insulating layer of the flat cable to be thinner, while keeping sufficient wear resistance and low temperature resistance.

BRIEF DESCRIPTION OF THE DRAWINGS

FIG. 1 illustrates a flat cable as prepared in accordance with the examples. FIG. 1(*a*) is a cross-sectional view of a conductor portion of the flat cable, and FIG. 1(*b*) is a cross-sectional view of the flat cable.

DETAILED DESCRIPTION OF THE INVENTION

In one embodiment of the invention, a resin material for a flat cable is a vinyl chloride-based resin composition. In other words, the base resin is polyvinyl chloride. If the resin composition is not a vinyl chloride-based resin composition, performances needed for a flat cable suitable for use in a vehicle, such as flame-retarding properties, low temperature resistance, and thinner layer of an insulating layer cannot be met.

Preferably, polyvinyl chloride which can be used in the invention has an average degree of polymerization as measured in accordance with JIS K6720 of from 700 to 3000. The average degree of polymerization is more preferably 1300 to 2000. If the average degree of polymerization is overly low, wear resistance, low temperature resistance, and heating deformation properties may be lowered. To the contrary, if the average degree of polymerization is overly high, extrusion molding may be adversely affected.

The vinyl chloride-based resin composition used as an insulating layer material of a flat cable in accordance with the invention can be prepared or formulated by blending polyvinyl chloride as a base resin, a plasticizer, a stabilizer, a filler, and a processing aid.

During the preparation of the above resin composition, the resin composition is adjusted such that its brittle temperature is from −40 Celsius degrees to −25 Celsius degrees, hardness D is from 35 to 55, and heating deformation is 10% or below. If the brittle temperature is overly low, sufficient wear resistance cannot be obtained. In comparison, if the brittle temperature is overly high, sufficient low temperature resistance cannot be obtained.

Exemplary plasticizer which can be used in the invention includes, but is not limited to, trimellitic acid-based plasticizer, phthalic acid-based plasticizer, epoxy-based plasticizer, adipic acid-based plasticizer, sebacic acid-based plasticizer, phosphoric acid-based plasticizer, pyromellitic acid-based plasticizer, polyester-based plasticizer, or a combination thereof. The combination of the afore-mentioned plasticizers may enhance the required material physical properties. The content of the plasticizer may be from 35 parts by mass to 55 parts by mass based on 100 parts by mass of the base resin, polyvinyl chloride. If the content of the plasticizer is overly low, sufficient flexibility and/or low temperature resistance may not be obtained. In comparison, if the content of the plasticizer is overly high, sufficient wear resistance and/or heating deformation may not be obtained.

In terms of low temperature resistance, it is preferred to use a trimellic acid-based plasticizer having C8 and C10 mixed normal alkyl group, or a phthalic acid-based plasticizer, DUP (undecyl alcohol phthalic acid ester) as a phthalic acid-based plasticizer, or a combination thereof. As the trimellic acid-based plasticizer having C8 and C10 mixed normal alkyl group, trimellic acid-based plasticizer, TOTM available from J-Plus Co. Ltd may be used.

The content of the plasticizer is preferably from 35 parts by mass to 55 parts by mass based on 100 parts by mass of the polyvinyl chloride as the base resin. If the content of the plasticizer is overly less, low temperature resistance may be lowered or degraded. In comparison, if the content of the plasticizer is overly high, wear resistance and heating deformation may be lowered or degraded.

A stabilizer should not contain a harmful heavy metal, and includes, but is not limited to, a complex stabilizer such as Ca—Zn stabilizer, Ba—Zn stabilizer, and Mg—Zn stabilizer. The content of the stabilizer is preferably from 1 part by mass to 10 parts by mass based on 100 parts by mass of polyvinyl chloride as the base resin. More preferably, the content of the stabilizer is from 3 parts by mass to 7 parts by mass. If the content of the stabilizer is overly low, due to heat generated during kneading or processing molding such as extrusion molding the degradation of the resin may proceed, and the material properties may be thus degraded. Even if the content of the stabilizer is added in an amount higher than the higher limit, proportional increase in such properties or effects with the increase in the content of the stabilizer is not seen any more. Furthermore, because the stabilizer is generally more expensive than the other material, manufacture cost will increase accordingly.

The filler includes, but is not limited to, light calcium carbonate, heavy calcium carbonate, mica, pentonite, zeolite, hydrated lime, kaolin, or diatomaceous earth.

If the filler has a particle diameter of from 20 nm to 200 nm and is formed of light calcium carbonate, the surface of which is treated with fatty acid, a property of dispersion in the resin is enhanced, and adhesion or affinity to the resin is also enhanced. For the reason, with the use of the above filler in the resin composition for the insulating covering of an electrical wire, low temperature resistance and wear resistance can be enhanced, as well as, the deterioration of heating deformation (rate) can be suppressed. If the particle diameter is greater than the upper limit, the adhesion or affinity between the filler and the resin is lowered, thereby causing low temperature resistance and wear resistance to decrease. In comparison, if the particle diameter is less than the lower limit, cost increase is caused, but the increase in effect (for example, proportional increase in effect) may not be obtained with the cost increase.

The content of the filler is preferably from 10 to 30 given that the added amount of the plasticizer is 100. If the content of the filler is overly less, deterioration or degradation of wear resistance and heating deformation cannot be avoided. In comparison, if the content of the filler is overly high, the deterioration or degradation of wear resistance is caused.

The processing aid which can be used in accordance with the invention, includes, but is not limited to, acrylic-based processing aid, polyethylene-based processing aid, polypropylene-based processing aid, or montanic acid-based processing aid. The content of the processing aid is from 0.1 parts by mass to 10 parts by mass based on 100 parts by mass of the base resin (i.e., polyvinyl chloride). More preferably, the content of the processing aid is from 0.5 parts by mass to 3 parts by mass based on 100 parts by mass of the base resin. If the processing aid is overly less, the appearance of the surface of the electrical wire is compromised during extrusion molding. In comparison, if the processing aid is overly high, the output of the resin may be unstable during the extrusion molding, thereby rendering the configuration of the electrical wire thus obtained unstable.

One embodiment of the polyvinyl chloride resin composition for the insulating covering of the flat cable may include from 35 to 55 parts by mass of plasticizer, which may be trimellic acid-based plasticizer having C8 and C10 mixed normal alkyl group, a phthalic acid-based plasticizer, DUP (undecyl alcohol phthalic acid ester), or a combination thereof, based on 100 parts by mass of polyvinyl chloride; and from 10 to 30 parts by mass of light calcium carbonate having the average diameter of from 20 nm to 200 nm, the surface of which is treated with fatty acid, as the filler, based on 100 parts by mass of the plasticizer.

In addition, one embodiment of the polyvinyl chloride resin composition for the insulating covering of the flat cable may further include a colorant such as organic pigment and inorganic pigment. One embodiment of the polyvinyl chloride resin composition for the insulating covering of the flat cable can be mixed by means of Henschel mixer, and is then adjusted by a kneading means such as a roll mill, a kneader, and Banbury mixer. Subsequently, the polyvinyl chloride resin composition may be pelleted via extrusion molding, as needed.

In accordance with the invention, the brittle temperature is measured by JIS K6723 6.6. The vinyl chloride-based resin composition for the insulating covering of the flat cable in accordance with the invention should have a brittle temperature of from −40 Celsius degrees to −25 Celsius degrees. If the brittle temperature is overly low, the wear resistance of the insulating covering is lowered. To the contrary, the brittle temperature is overly high, the flexibility of the flat cable thus obtained therefrom may not be sufficient under a low temperature condition. In addition, the insulating covering becomes brittle, thereby lowering insulating properties thereof. In order to attain the above range of the brittle temperature, the degree of polymerization of the base resin used, and a kind of and content of the plasticizer can be properly selected and adjusted.

In accordance with the invention, the hardness D is measured by JIS K6253, and is measured at 10 seconds after starting the measurement. The hardness D of the vinyl chloride-based resin composition for the covering of the flat cable in accordance with the invention should be in a range of from 35 to 55. If the hardness D is overly low, the wear resistance of the flat cable as obtained therefrom is lowered or deteriorated. To the contrary, if the hardness D is overly high, the flexibility of the flat cable as obtained therefrom may not be sufficient under a low temperature condition. In order to attain the above range of the hardness D, the degree of polymerization of the base resin used, and a kind of and content of the plasticizer used can be properly selected and adjusted.

In accordance with the invention, the heating deformation is measured by JIS K6723 6.5. The polyvinyl chloride-based resin composition for the insulating layer of the flat cable in accordance with the invention should have a value of heating deformation of 10% or below. If the value of heating deformation is overly high, sufficient insulating properties of the covering may not be obtained under a high temperature condition. In order to attain the heating deformation of 10% or below, the degree of polymerization of the base resin used, and a kind of and content of the plasticizer used can be properly selected and adjusted.

In accordance with one embodiment of the flat cable, a conductor may be formed of a conductor material, which is usually used for a conductor of a flat cable, for example, copper such as electric copper, copper alloy, aluminum, or aluminum alloy.

A conductor for the flat cable in accordance with the invention may be formed of a single wire or stranded wires, and has a cross-sectional area of from 0.01 $mm^2$ to 0.13 $mm^2$. Alternatively, the conductor may be a rectangular conductor. In the case of the rectangular conductor, the width of the conductor is greater than the thickness of the conductor, and the thickness of the conductor may be from 0.02 mm to 0.5 mm. In other words, the afore-mentioned conductors can attain sufficient flexibility, space-saving, and downsizing required for the flat cable for the vehicle.

The flat cable in accordance with the invention can be prepared by forming the insulating covering over the periphery of the Conductor, which may be at least two conductors spaced apart from each other and in parallel to each other, via molding. The insulating covering is prepared by using the afore-mentioned vinyl chloride-based resin composition. In the case of using the rectangular conductor, the conductor is arranged and insulated such that the width direction of the conductor, which is greater than the thickness of the conductor, corresponds to the width direction of the flat cable. For the preparation of the insulating covering, extrusion molding may be employed. Alternatively, a plurality of films or sheets is prepared from the vinyl chloride-based resin composition, and is then laminated.

The flat cable thus obtained becomes thinner such that the thickness of the insulating covering disposed over the periphery of the conductor portion of from is in a range of from 0.1 mm to 0.2 mm, while ensuring sufficient wear resistance and low temperature resistance.

While the invention has been explained with reference to the preferred embodiment, the flat cable of the invention is not limited to the above preferred embodiment.

The present invention has been described in terms of one or more preferred embodiments, and it should be appreciated that many equivalents, alternatives, variations, and modifications, aside from those expressly stated, are possible and within the scope of the invention.

Examples

Examples of the flat cable in accordance with the invention will be hereinafter described.

Examples 1-10 and Comparative examples 1-12 of vinyl chloride-based resin composition were prepared using materials A to G as listed in Table 1 in an amount (i.e., parts by mass) as respectively listed in Table 2, 4, and 5. The material was blended, then mixed by means of Banbury mixer, and then kneaded. These resin compositions were respectively applied onto the periphery of the conductor portion formed of five single wires (electric copper) having a diameter of 0.32 mm and cross-sectional area of 0.08 $mm^2$ such that the five single wires are arranged at an interval of 2.0 mm and in parallel to each other on the same plane, and subjected to extrusion molding. As a result, a model flat cable as shown in FIG. 1(*b*) having a thickness (T) of 0.62 mm, a width (W) of 9.9 mm, and a thickness of the insulating covering disposed over the conductor portion ($T_1$) of 0.15 mm, and a thickness of a bridge portion ($T_2$) of 0.15 mm was obtained. However, the diameter of the conductor ($T_0$), the distance between two adjacent conductors (P) and the thickness of the insulating layer ($T_1$) were respectively modified in accordance with the dimensions as listed in Tables 2, 4, and 5. A total of 22 flat cables were prepared.

In addition, Examples 11-16 of vinyl chloride-based resin composition were prepared using materials A to G as listed in Table 1 in an amount (i.e., parts by mass) as listed in Table 3. Examples 11-16 were prepared in the same manner as Examples 1-10. These resin compositions (i.e., Examples 11-16) were respectively applied onto the periphery of a conductor portion formed of rectangular conductors (electric copper) having width and thickness as listed in Table 3 such that the rectangular conductors are arranged at an interval as listed in Table 3 and in parallel to each other on the same plane, and subjected to extrusion molding. As a result, total of 6 flat cables including rectangular conductor were prepared.

TABLE 1

| | Material | |
|---|---|---|
| A | polyvinyl chloride | TH-2000 available from Taiyo Vinyl Corporation (Degree of polymerization A) |
| B | polyvinyl chloride | TH-1300 available from Taiyo Vinyl Corporation (Degree of polymerization B) |
| C | Plasticizer | Trimellic acid-based plasticizer, TOTM available from J-Plus Co. Ltd |
| D | Plasticizer | Phthalic acid-based plasticizer, DINP available from J-Plus Co. Ltd |
| E | Plasticizer | Ca—Zn-based stabilizer, RUP-14 available from ADEKA Corporation |
| F | plasticizer | Light calcium carbonate, Calcitech Vigot-15 available from Shiraishi Kogyo |
| G | Processing aid | Acrylic processing aid, P-551A available from Mitsubishi Rayon Co., Ltd. |

TABLE 2

| | Ex. 1 | Ex. 2 | Ex. 3 | Ex. 4 | Ex 5 | Ex. 6 | Ex. 7 | Ex. 8 | Ex. 9 | Ex. 10 |
|---|---|---|---|---|---|---|---|---|---|---|
| A | 100 | 100 | 100 | | | | | 100 | 100 | 100 |
| B | | | | 100 | 100 | 100 | 100 | | | |
| C | 37 | 30 | 52 | 35 | 50 | 50 | 50 | 37 | 37 | 52 |
| D | | 10 | | 10 | | | | | | |
| E | 3 | 3 | 3 | 3 | 3 | 3 | 3 | 3 | 3 | 3 |
| F | 10 | 5 | 5 | 5 | 5 | 5 | 5 | 10 | 10 | 5 |
| G | 1 | 1 | 1 | 1 | 1 | 1 | 1 | 1 | 1 | 1 |
| Hardness D | 55 | 52 | 42 | 41 | 35 | 35 | 35 | 55 | 55 | 42 |
| Brittle temperature (° C.) | −25 | −27 | −40 | −27 | −31 | −31 | −31 | −25 | −25 | −40 |
| Heating deformation (%) | 4 | 6 | 7 | 7 | 10 | 10 | 10 | 4 | 4 | 7 |
| Diameter $T_0$ (mm) | 0.10 | 0.10 | 0.10 | 0.10 | 0.10 | 0.32 | 0.40 | 0.32 | 0.40 | 0.40 |
| Distance P (mm) | 2.00 | 2.00 | 2.00 | 2.00 | 2.00 | 2.00 | 2.00 | 2.00 | 2.00 | 2.00 |
| Thickness $T_1$ (mm) | 0.10 | 0.10 | 0.10 | 0.10 | 0.10 | 0.15 | 0.20 | 0.15 | 0.20 | 0.20 |
| Wear resistance | ○ | ○ | ○ | ○ | ○ | ○ | ○ | ◎ | ◎ | ◎ |

TABLE 2-continued

| | Ex. 1 | Ex. 2 | Ex. 3 | Ex. 4 | Ex 5 | Ex. 6 | Ex. 7 | Ex. 8 | Ex. 9 | Ex. 10 |
|---|---|---|---|---|---|---|---|---|---|---|
| Low temperature resistance | ○ | ○ | ○ | ○ | ○ | ○ | ○ | ○ | ○ | ○ |
| Heating deformation | ○ | ○ | ○ | ○ | ○ | ○ | ○ | ○ | ○ | ○ |

TABLE 3

| | Ex. 11 | Ex. 12 | Ex. 13 | Ex. 14 | Ex. 15 | Ex. 16 |
|---|---|---|---|---|---|---|
| A | 100 | 100 | | 100 | 100 | |
| B | | | 100 | | | 100 |
| C | 37 | 52 | 50 | 37 | 52 | 50 |
| D | | | | | | |
| E | 3 | 3 | 3 | 3 | 3 | 3 |
| F | 10 | 5 | 5 | 10 | 5 | 5 |
| G | 1 | 1 | 1 | 1 | 1 | 1 |
| Hardness D | 55 | 42 | 35 | 55 | 42 | 35 |
| Brittle temperature (° C.) | −25 | −40 | −31 | −25 | −40 | −31 |
| Heating deformation (%) | 4 | 7 | 10 | 4 | 7 | 10 |
| Diameter (mm) | 0.02 | 0.02 | 0.02 | 0.50 | 0.50 | 0.50 |
| Width (mm) | 0.50 | 0.50 | 0.50 | 1.00 | 1.00 | 1.00 |
| Distance P (mm) | 2.00 | 2.00 | 2.00 | 2.00 | 2.00 | 2.00 |
| Thickness (mm) | 0.10 | 0.10 | 0.10 | 0.20 | 0.20 | 0.20 |
| Wear resistance | ○ | ○ | ○ | ◎ | ◎ | ○ |
| Low temperature resistance | ○ | ○ | ○ | ○ | ○ | ○ |
| Heating deformation | ○ | ○ | ○ | ○ | ○ | ○ |

TABLE 4

| | Com Ex. 1 | Com Ex. 2 | Com Ex. 3 | Com Ex. 4 | Com Ex. 5 | Com Ex. 6 |
|---|---|---|---|---|---|---|
| A | 100 | 100 | 100 | | | |
| B | | | | 100 | 100 | 100 |
| C | 60 | 33 | 25 | | 58 | 25 |
| D | | | | 42 | | 8 |
| E | 3 | 3 | 3 | 3 | 3 | 3 |
| F | | | | | | |
| G | 1 | 1 | 1 | 1 | 1 | 1 |
| Harness D | 34 | 56 | 65 | 42 | 30 | 48 |
| Brittle temperature (° C.) | −47 | −22 | −12 | −24 | −41 | −16 |
| Heating deformation (%) | 10 | 4 | 2 | 7 | 12 | 4 |
| Diameter $T_0$ (mm) | 0.10 | 0.10 | 0.10 | 0.10 | 0.10 | 0.10 |
| Distance P (mm) | 2.00 | 2.00 | 2.00 | 2.00 | 2.00 | 2.00 |
| Thickness $T_1$ (mm) | 0.10 | 0.10 | 0.10 | 0.10 | 0.10 | 0.10 |
| Wear resistance | X | ◎ | ◎ | ○ | X | ○ |
| Low temperature resistance | ○ | X | X | X | ○ | X |
| Heating deformation | ○ | ○ | ○ | ○ | X | ○ |

TABLE 5

| | Com Ex. 7 | Com Ex. 8 | Com Ex. 9 | Com Ex. 10 | Com Ex. 11 | Com Ex. 12 |
|---|---|---|---|---|---|---|
| A | 100 | 100 | 100 | | | |
| B | | | | 100 | 100 | 100 |
| C | 60 | 33 | 25 | | 58 | 25 |
| D | | | | 42 | | 8 |
| E | 3 | 3 | 3 | 3 | 3 | 3 |
| F | | | | | | |
| G | 1 | 1 | 1 | 1 | 1 | 1 |
| Hardness D | 34 | 56 | 65 | 42 | 30 | 48 |
| Brittle temperature (° C.) | −47 | −22 | −12 | −24 | −41 | −16 |
| Heating deformation (%) | 10 | 4 | 2 | 7 | 12 | 4 |
| Diameter $T_0$ (mm) | 0.40 | 0.40 | 0.40 | 0.40 | 0.40 | 0.40 |
| Distance P (mm) | 2.00 | 2.00 | 2.00 | 2.00 | 2.00 | 2.00 |
| Thickness $T_1$ (mm) | 0.20 | 0.20 | 0.20 | 0.20 | 0.20 | 0.20 |
| Wear resistance | X | ◎ | ◎ | ◎ | X | ◎ |
| Low temperature resistance | ○ | X | X | X | ○ | X |
| Heating deformation | ○ | ○ | ○ | ○ | ○ | ○ |

The samples thus obtained were subjected to the following evaluation tests.

Hardness D (after 10 seconds) was measured in accordance with JIS K6253.

Brittle temperature (cold resistance) was measured in accordance with JIS K6723 6.6.

Heating deformation was measured in accordance with JIS K6723 6.5.

Wear Resistance Test

Wear resistance test was carried out in accordance with ISO6722 5.12. For more detail, the flat cable was cut along a longitudinal direction of the conductor such that the cut flat cables had the same width and included only one conductor therein. The samples (i.e., the cut flat cables) were subjected to rubbing or friction by means of a sandpaper under a weight of 100 g. Four frictions or rubbings were respectively performed for a front surface and a back surface of each sample. In other words, total of eight frictions or rubbings were performed per one sample. If the average (sandpaper) wear resistance value of the total eight frictions or rubbings is 400 mm or above, the sample was evaluated to have excellent wear resistance, and a double circle was recorded. If the average wear resistance value of the total eight frictions or rubbings is 200 mm or above, the sample was evaluated to have good wear resistance and a circle was recorded. If the average wear resistance vale of the total eight friction or rubbings is less than 200 mm, the sample was evaluated to have poor wear resistance and "X" was recorded.

Low Temperature Resistance Test

Low temperature resistance test was performed by preparing a sample of the cut flat cable having a length of 350 mm, placing the sample in a low temperature bath for a period of four hours, and manually bending 180 degrees at the middle portion of the sample along its longitudinal direction in the low temperature bath. After the samples, in particular, the bent middle portions of the samples were visually observed. If the conductor was not exposed and crack of the insulating covering did not occur, the sample was evaluated to have sufficient low temperature resistance, and a circle was recorded. If the conductor was exposed or crack of the insulating covering occurred, the sample was evaluated to have poor low temperature resistance and "X" was recorded.

Heating Deformation Test

Insulating performance test was performed in accordance with high temperature pressure test of ISO6722 5.8. In this test, the same cut samples as used in the wear resistance test were employed. The samples were placed in a temperature of 100 Celsius degrees under a predetermined downward weight for a period of four hours. Subsequently, a voltage of 1 kV was applied to the conductor of the sample by means of a voltage resistance apparatus. If the insulating (property) was kept for one minute, the sample was evaluated to have enough insulating performance, and a circle was recorded. If the insulating was kept only for a period of time less than one minute, the sample was evaluated to have poor insulating performance, "X" was recorded.

These evaluation results are summarized in Table 2 and Table 3 as listed above.

In view of the tables, it is understood that the resin composition in accordance with the invention makes the insulating layer of the flat cable to be thinner, while keeping sufficient wear resistance and low temperature resistance.

The invention claimed is:

1. A flat cable, comprising:

at least two conductors disposed apart from each other and in parallel to each other, and an insulating covering disposed over a periphery of the at least two conductors, and formed of a vinyl chloride-based resin composition having a brittle temperature of from −40 Celsius degrees to −25 Celsius degrees, a hardness D of from 35 to 55, and heating deformation of 10% or below, wherein the vinyl chloride-based resin composition substantially contains only vinyl chloride homopolymer as resin component.

2. The flat cable in accordance with claim 1, wherein a thickness of the insulating covering disposed over each conductor is from 0.1 mm to 0.2 mm, and wherein each conductor is formed of a single wire or a stranded wire and has a cross-sectional area of from 0.01 $mm^2$ to 0.13 $mm^2$.

3. The flat cable in accordance with claim 1, wherein a thickness of the insulating covering disposed over each conductor is from 0.1 mm to 0.2 mm, wherein each conductor is a rectangular conductor having a width greater than a thickness of the rectangular conductor, wherein the thickness of the rectangular conductor is from 0.02 mm to 0.5 mm, and wherein each rectangular conductor is arranged such that a width direction of the rectangular conductor corresponds to a width direction of the flat cable.

4. A flat cable according to claim 1, wherein the thickness of the bridge portion is less than the thickness of either of the two conductors.

5. A flat cable according to claim 1, wherein the thickness of the bridge portion is substantially equal to a thickness of the peripheral portion.

6. A flat cable having at least two conductors, comprising:

a bridge portion made of a vinyl-chloride-based resin composition having a brittle temperature of from −40 Celsius degrees to −25 Celsius degrees, a hardness D of from 35 to 55, and heating deformation of 10% or below, wherein the bridge portion is disposed between two of the conductors, substantially contains only vinyl chloride homopolymer as resin component, and has a thickness less than a thickness of either of the two conductors.

* * * * *